US006874488B2

(12) United States Patent
Ieda

(10) Patent No.: US 6,874,488 B2
(45) Date of Patent: Apr. 5, 2005

(54) EXHAUST GAS DEFLECTOR VALVE

(75) Inventor: João José Cardinali Ieda, Piracicaba (BR)

(73) Assignee: Wahler Metalurgica Ltda, Sao Paulo (BR)

( * ) Notice: Subject to any disclaimer, the term of this patent is extended or adjusted under 35 U.S.C. 154(b) by 0 days.

(21) Appl. No.: 10/788,680

(22) Filed: Feb. 27, 2004

(65) Prior Publication Data

US 2004/0187486 A1 Sep. 30, 2004

(30) Foreign Application Priority Data

Feb. 27, 2003 (BR) ..... PI 0300426

(51) Int. Cl.[7] ..... F02M 25/07

(52) U.S. Cl. ..... 123/568.27; 123/568.11; 123/568.12

(58) Field of Search ..... 123/323, 568.11, 123/568.12, 568.17, 568.18, 568.19, 568.21, 568.23–568.31; 60/324

(56) References Cited

U.S. PATENT DOCUMENTS 4,020,809 A * 5/1977 Kern et al. ..... 123/568.24
5,305,720 A * 4/1994 Ando et al. ..... 123/568.24
5,520,161 A * 5/1996 Klopp ..... 123/568.24
5,531,205 A * 7/1996 Cook et al. ..... 123/568.24
5,666,930 A * 9/1997 Elder ..... 123/568.12
5,740,785 A * 4/1998 Dickey et al. ..... 123/568.12
5,746,190 A * 5/1998 Honda ..... 123/568.18
6,062,205 A * 5/2000 Bevan et al. ..... 123/568.24
6,135,415 A * 10/2000 Kloda et al. ..... 123/568.24
6,575,149 B2 * 6/2003 Gagnon ..... 123/568.24
6,681,799 B2 * 1/2004 Gagnon ..... 123/568.24

* cited by examiner

*Primary Examiner*—Willis R. Wolfe, Jr.
(74) *Attorney, Agent, or Firm*—William J. Sapone; Coleman Sudol Sapone P.C.

(57) ABSTRACT

A gas deflector valve is incorporated with an engine cooling system, and located before an inlet to a heat exchanger used to cool hot gas from the engine as part of an EGR system. The gas diverter valve conducts the gas from the engine to the heat exchanger of the EGR system when its temperature is above normal and its cooling is required, or diverts the gas to recycle the gas directly to the engine, without it passing through the heat exchanger when the gas temperature is below the minimum limits for cooling. The gas deflector valve is actuated by a pneumatic actuator responsive to an electric signal from the engine's electronic control center.

7 Claims, 3 Drawing Sheets

EXHAUST GAS DEFLECTOR VALVE

TECHNICAL FIELD

This invention is directed to an exhaust gas deflector valve for use in an automobile.

BACKGROUND

This invention is directed to an exhaust gas deflector valve for use in an automobile, preferably in relation to an exhaust gas recirculation (EGR) system, having as the main purpose conducting exhaust gas through a heat exchanger that acts as a gas cooler when cooling is required and, when the gas is below the minimum limits for cooling, deflecting and thereby recycling the gas directly to the engine, without it passing through the heat exchanger.

The gas deflector valve is activated by a vacuum or pressure pneumatic system, preferably by means of a directed valve actuated by an electric signal from the engine's electronic control center.

Use of the inventive gas deflector valve assures gas recycling at an optimum temperature, improving or maintaining performance of the internal combustion engine as regards combustion, specific power, specific consumption, transience of operation and control of pollutant emissions. The use of the gas deflector valve reduces the occurrence of gas condensation and, consequently, non-operation of components and accessories of the system for control of pollutant emissions, due to soot, oil, water deposits, and other residues from combustion on the walls of equipment, the heat exchanger, ducts and EGR valve, inlet manifold, nipples and other components.

The invention is best understood with reference to the attached illustrative drawings, with reference to the detailed description below.

BRIEF DESCRIPTION OF THE DRAWINGS

The inventive gas deflector valve is described and shown in two versions, different only in the location of the element for blocking/releasing the gas passage.

DETAILED DESCRIPTION OF THE INVENTION

Figure 1:
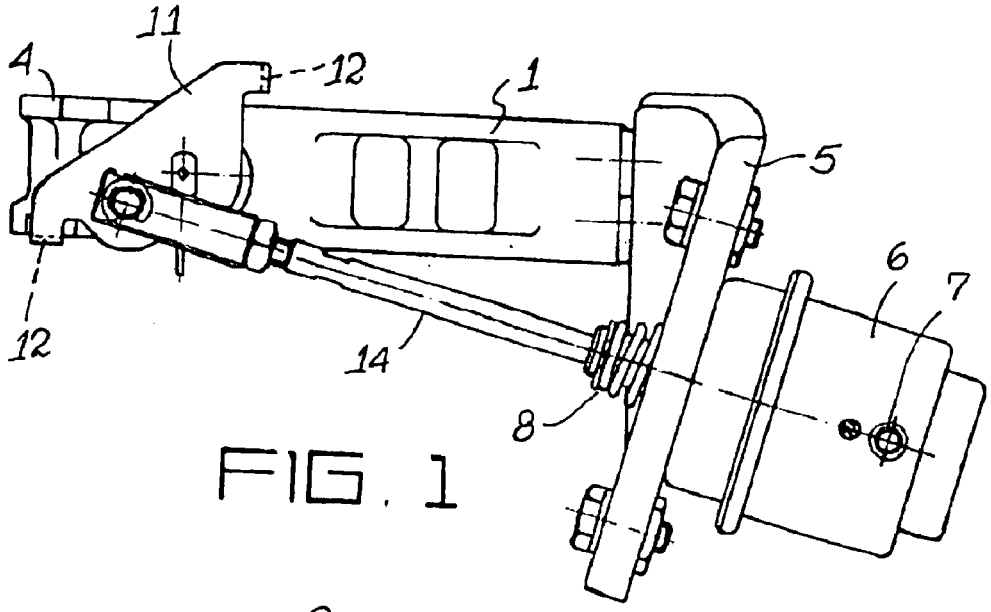
FIG. 1 shows the lower view of the gas deflector valve, first version.
Figure 2:
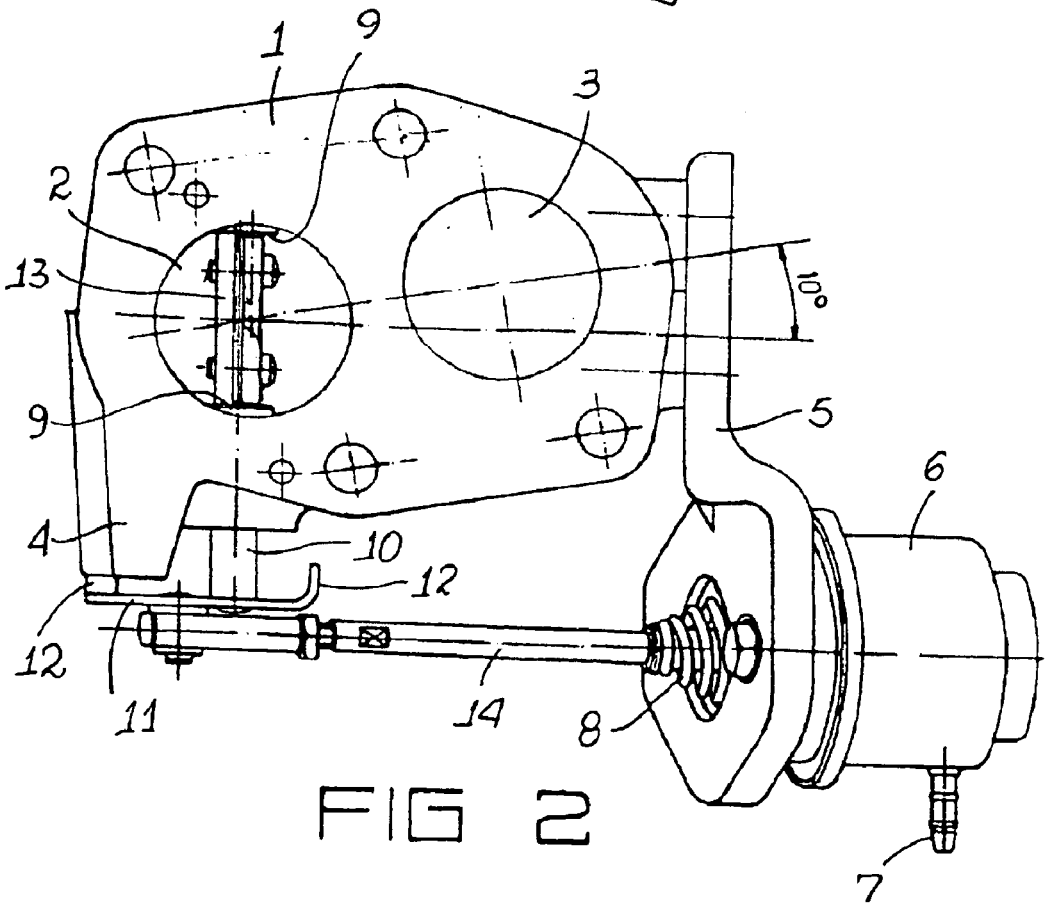
FIG. 2 shows a plan view of the gas deflector valve, first version.

As can be seen from FIGS. 1 and 2, the first version of the gas deflector valve has a flat block (1) with a specific peripheral configuration. Two adjacent circular openings (2) and (3) define exhaust gas passages, with a lower projection (4) at one end at the opposite end coupled to a support (5) of a vacuum or pressure pneumatic valve (6), equipped with a nipple (7) for connecting to a system hose, the valve subject to the biasing action of a draw spring (8).

One of the circular openings (2) has an upper through hole and a lower through hole, to which roller bearings or bushings (9) are assembled for supporting rotation of a shaft

(10) perpendicular to the gas flow. The shaft has a lower terminal end which penetrates the lower hole and extends out from a lower part of the block (1). The extended end of this shaft (10) is connected to a plate (11) equipped at the ends with two upper lips (12) that act as limiters of the rotary motion of the shaft, with angular displacement of the plate (11) causing the lips to engage one or another side of a block extension (4).

In an interior of the opening (2) is an element for blocking/releasing the gas passage, defined by a "butterfly" valve (13), riveted to the shaft (10).

Incorporated to the actuator (6) is an axial rod (14) extending throughout a lower length of the block (1). The end of the rod (14) is articulated to the plate (11), whose point of articulation is eccentric to the point of connection of the shaft (10), and therefore, this rod (14) works as a connecting rod, converting the rectilinear motion of the shaft (10) into circular motion, thereby controlling the butterfly valve attached thereto.

Figure 3:
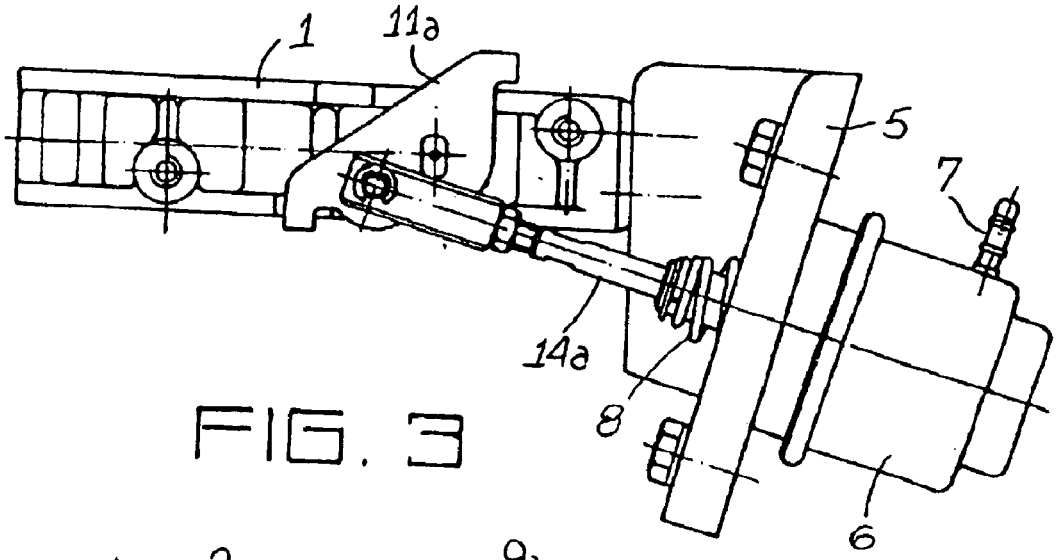
FIG. 3 shows the lower view of the gas deflector valve, second version.
Figure 4:
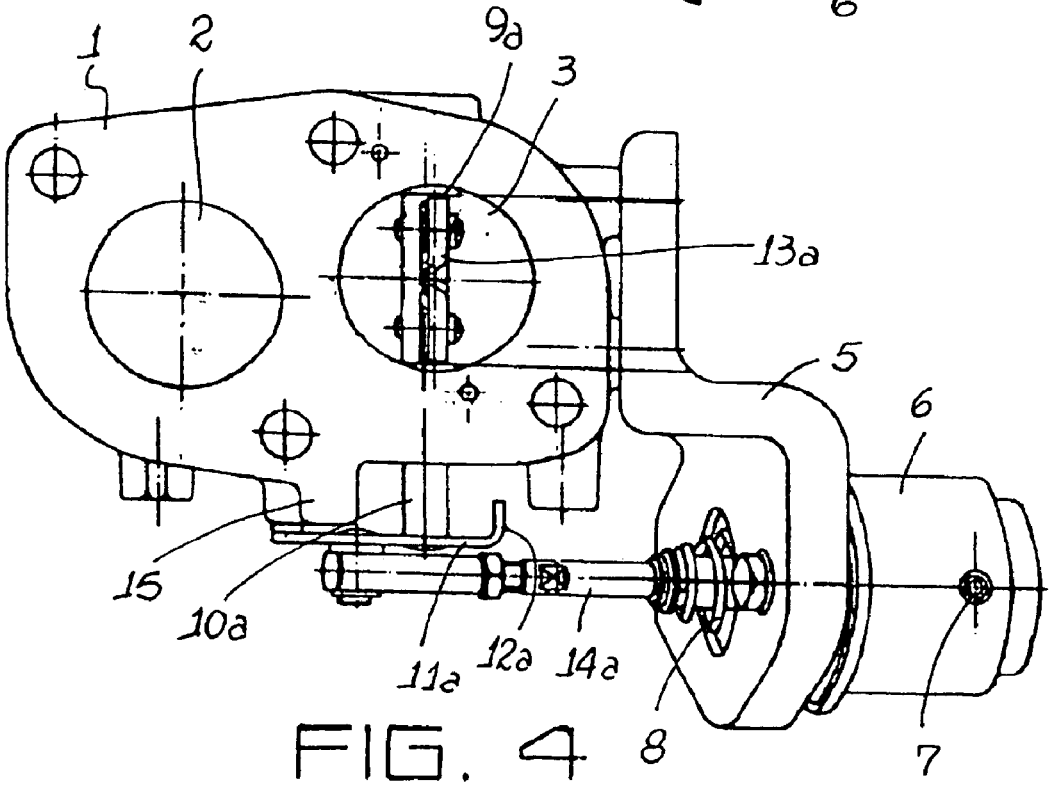
FIG. 4 shows a plan view of the gas deflector valve, second version.

The second version of the gas deflector valve set (FIGS. 3 and 4) presents small differences in relation to the first version, such as the fact that the element for blocking/releasing the gas passage, or the "butterfly valve" **(13*a*), is installed in the second circular opening (3) of the block, where the upper and lower through holes are located. Bearings or bushings (9*a*) support rotation of the shaft by reducing friction on the shaft (10*a*), located perpendicular to the gas flow and to which the "butterfly" valve (13*a*) is riveted. In this case, the axial rod (14*a*) of the vacuum or pressure pneumatic valve (6) is shorter and extends up to a mid-length of the block (1), which has a shoulder (15) that acts as a top to limit the circular motion, with angular displacement of the plate (11*a*) causing one or another upper lip (12*a*)** of the plate to engage the shoulder. The working is identical to that of the first version.

Figure 5:
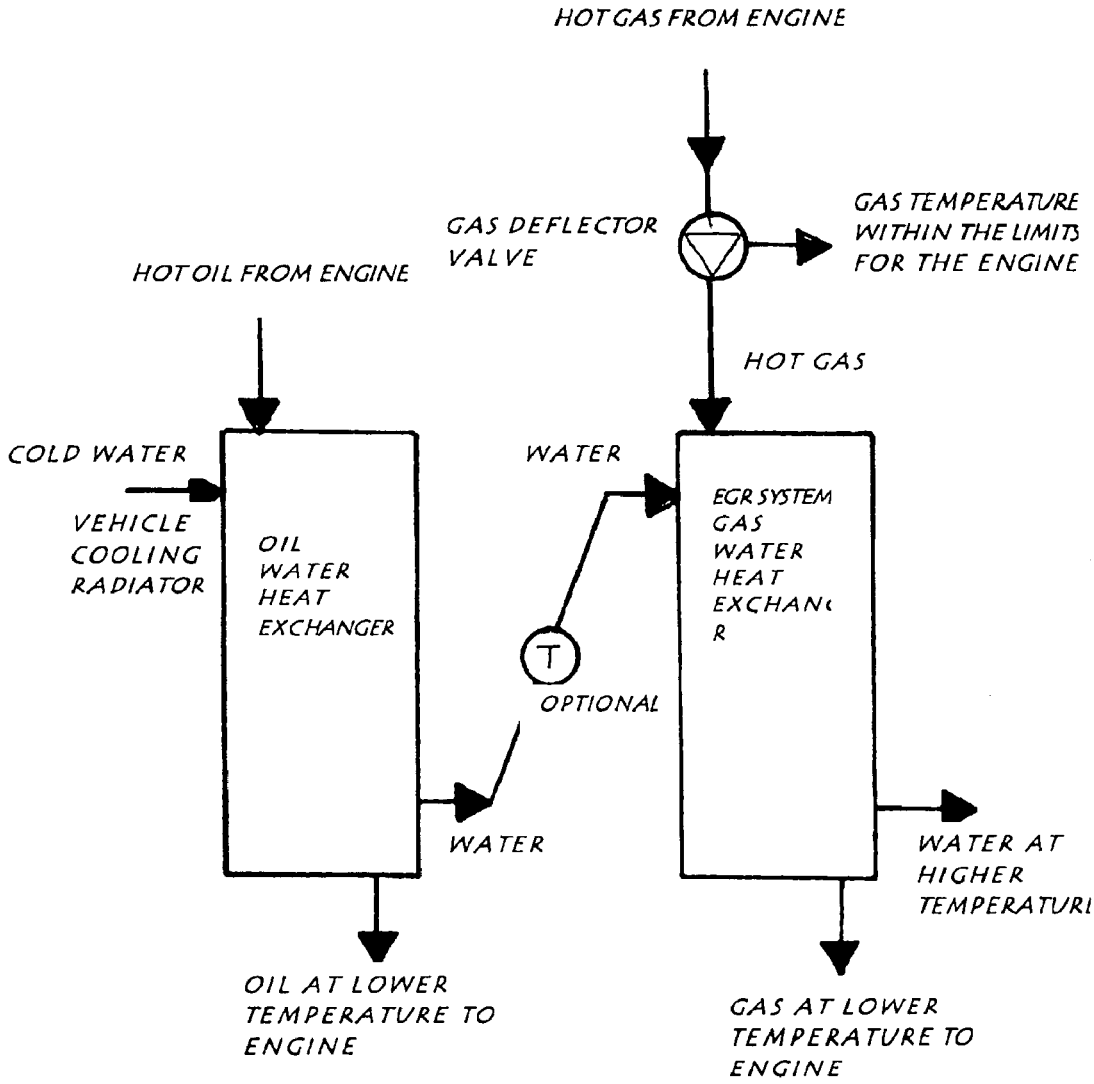
FIG. 5 shows a schematic representation of the engine cooling system, with the gas deflector valve of the invention.

FIG. 5 shows a schematic of the engine cooling system, with the gas deflector valve installed before the inlet of the hot gas of the engine in the gas/water heat exchanger of the EGR system.

The inclusion of the gas deflector valve has the advantage that the gas from the engine is only conducted to the heat exchanger of the EGR system when its temperature is above normal and cooling is required. That is, the "butterfly" valve is opened by action of the pneumatic actuator in such a way that the passage of the gas is released toward the heat exchanger of the EGR system. When the gas temperature is below the minimum limits for cooling, the gas is recycled directly to the engine, without passing through the heat exchanger. That is, the "butterfly" valve is activated by pneumatic actuation in such a way as to cause blocking and unblocking to cause a redirection of flow, which details depends on the circuit and layout of the various systems for cooling and control of emissions from internal combustion engines.

The inventive gas deflector valve fully satisfies the proposed objectives, performing the functions for which it was designed in a practical and efficient manner, providing a series of advantages inherent to its applicability, and giving it unique and innovative features possessing the fundamental requirements for novelty.

What is claimed is:

1. A gas deflector valve for deflecting exhaust gas in a vehicle comprising a flat block (1) having two adjacent circular holes (2) and (3) that define passages for the gas passing there through, a lower projection (4) at one end of the block, another block end coupled to a support (5), actuator means mounted to the support and being biased by a spring (8); one of the circular holes (2) having an upper through hole and a lower through hole, bearing means located therein for supporting rotation of a shaft (10) located therein perpendicular to the gas flow therethrough, a lower terminal end of the shaft extending from said lower through hole at a bottom part of the block (1), the shaft end connected to a plate (11) having two upper lips (12) for limiting rotation of the shaft, angular displacement of the plate (11) causing the lips to engage stop means on the block; valve means mounted to the shaft and disposed in the opening for blocking/releasing the gas passage, blocking the passage diverting the exhaust gas flow, an axial rod (14) incorporated to the actuator means (6) being engaged at an end thereof to the plate (11), whose point of articulation is eccentric to a point of connection of the shaft (10), said rod (14) converting a rectilinear motion of said rod (10) into a circular motion of the shaft.

2. The gas deflector valve of claim 1 wherein the valve means are installed in the first circular opening (2) of the block, and the stop means are a projection (4) disposed on the block.

3. The gas deflector means of claim 1 wherein the valve means are located in the second circular opening (3) of the block, and the stop means are a shoulder (15).

4. The gas deflector means of claim 1 wherein the actuator is a vacuum or pressure pneumatic actuator.

5. The gas deflector means of claim 1 wherein the valve means comprise a butterfly valve.

6. The gas deflector of claim 4 further comprising a nipple on the actuator for connecting to a hose.

7. The gas deflector means of claim 1 wherein the actuator means are connected to a control system which directs opening and closing of the valve means in response to an exhaust gas temperature.

* * * * *